United States Patent [19]

Coleman et al.

[11] 4,389,772

[45] Jun. 28, 1983

[54] ELECTRIC DRY SHAVER

[75] Inventors: Donald J. Coleman, Lisle; Wilbur C. Jackson, Wheaton; Robert R. Lube, Countryside; Albert R. Spohr, Park Ridge, all of Ill.

[73] Assignee: Sunbeam Corporation, Chicago, Ill.

[21] Appl. No.: 163,743

[22] Filed: Jun. 27, 1980

[51] Int. Cl.[3] ..... B26B 19/12

[52] U.S. Cl. ..... 30/43.9

[58] Field of Search ..... 30/34.1, 43.9, 43.92

[56] References Cited

U.S. PATENT DOCUMENTS

| | | | |
|---|---|---|---|
| 2,917,824 | 12/1959 | Brauss | 30/34.1 |
| 3,421,215 | 1/1969 | Bauer | 30/43.9 |
| 3,447,058 | 5/1969 | Stahly et al. | 30/43.9 |
| 3,690,000 | 9/1972 | Loner | 30/34.1 |
| 3,783,508 | 1/1974 | Brown | 30/34.1 |
| 3,889,371 | 6/1975 | de Boer | 30/34.1 |
| 3,962,783 | 6/1976 | Rentema | 30/34.1 |
| 4,150,482 | 4/1979 | Beck et al. | 30/43.9 |
| 4,283,848 | 8/1981 | Messinger | 30/34.1 |

FOREIGN PATENT DOCUMENTS

| | | | |
|---|---|---|---|
| 54-100866 | 8/1979 | Japan | 30/34.1 |

*Primary Examiner*—Harold D. Whitehead
*Assistant Examiner*—Robert A. Rose
*Attorney, Agent, or Firm*—George R. Clark; Neil M. Rose; Clifford A. Dean

[57] ABSTRACT

An electric dry shaver having a movable long hair clipper which is slidable from a retracted position within the shaver housing to an extended position in which the clipping teeth of the clipper are exposed. The clipper includes a relatively fixed blade or comb supported by a molded plastic part which performs the functions of guiding the movable clipper, providing a detent action for the movable clipper and interconnecting the clipper assembly with a manually actuable member which extends through the wall of the shaving housing. The shaver also includes a roller supported between a pair of shaving heads by the means for tensioning the flexible comb on its supporting frame.

7 Claims, 11 Drawing Figures

4.
42
44
70a
10.
70b
70c
64
64
46
30
38
28
32a
48e
48
50g
72
41
50e
50e
41
39
39
32e
10.
52
32e
50f
50f
50
12
50b
56d
50c
56c
56e
58
56
56b
56d
56a
4.

ELECTRIC DRY SHAVER

BACKGROUND OF THE INVENTION

The present invention relates to electric dry shavers of the type which include a shaving head intended to be used for cutting facial hair or beard stubble very closely and also includes a long hair trimmer or clipper which is intended for use in cutting long hair such as may be found on sideburns, mustaches, beards or the like. It is well known that the shaving heads which are adapted to the close shaving of beard stubble are not suitable for clipping or trimming long hair. The explanation for this fact lies in the construction of the outer shaving member on a shaving head which member is usually termed the comb. The comb is normally constructed of thin material having perforations or slots through which the hair to be shaved extends with the movable cutter sweeping across such slots or perforations to shear the hairs along the edges of such slots or perforations. To avoid entry of the skin into such slots or perforations where it might be cut, it is necessary to make the width or diameter of such slots or perforations relatively small. Because of the small hole or slot size, long hair tends to be bent over or deflected by the shaver comb rather than having the long hairs enter into the slots or openings. Since it is necessary to cut long hair in performing any complete facial shaving operation, it has become conventional in recent years to provide a separate long hair trimmer of the type having open slots into which the long hairs may be moved for easy trimming. Such clippers function in much the same way as a barber's trimmer and are used in a similar fashion to trim sideburns, beards and mustaches.

In order to preserve the life of the trimmer, which is used only infrequently, it is conventional to provide means for selectively energizing the trimmer whenever it becomes necessary to trim long hair. It is also well known to mount the trimmer on a shaver in such a manner that it may be retracted to a nonuse position in which it will in no way interfere with or obstruct the use of the shaving head in performing the close shaving function. In connection with trimmers which are movable between a retracted and an exposed position, it is well known to structure the driving action between the shaver motor and the clipper so that it is engaged only when the clipper is in its exposed position. Examples in the prior art shavers having these features are found in Loner U.S. Pat. Nos. 3,781,990, Rentima 3,962,782 and Brauss 2,917,824. Other patents of interest in this regard are de Boer et al U.S. Pat. Nos. 3,780,434 and Buchholz 4,114,264.

BRIEF DESCRIPTION OF THE INVENTION

The shaver embodying our invention includes a movable long hair clipper which is slidably mounted within the shaver housing to move from a retracted position entriely within the housing to an exposed position in which the aligned clipper teeth are positioned to extend beyond the outer wall of the shaver housing throughout a slot provided therein. The shaver housing encloses a motor which is drivingly connected to a shaving head utilizing oscillating cutters which engage the underside of a perforated comb, the cutting action for shaving occurring as a consequence of the cutters moving across in shearing engagement with the underside of the perforated comb. The end of one of the oscillating cutter support shafts includes a yoke structure which serves to drive the reciprocating cutter in the clipper assembly. The clipper assembly includes a relatively fixed cutter or comb and a relatively movable cutter, each of which has a row of teeth formed along inner engaging edges of the cutters.

The fixed cutter or comb, as we may call it, has secured thereto a molded plastic part which provides a guide for the reciprocating cutter and also provides a guide for the cutter clipper assembly itself as well as detents which cooperate with interior portions of the shaver housing to position the movable clipper assembly in either the raised exposed position or the lowered retracted position. The molded plastic part also has means provided for interconnecting the clipper assembly with a manual actuator extending through the wall of the shaver housing providing means for moving the clipper assembly from its retracted to its exposed position. The manual operating button is formed with integral resilient means which engage adjacent portions of the shaver housing to bias the actuating member against one wall of the access slot to the housing so that there will be no unnecessary noise or rattling associated with the parts. The molded support for the clipper assembly is molded to the comb, and the biasing spring for urging the movable cutter into shearing engagement with the comb is secured to the lower shank portion of the molded support by means of a rivet. This results in a simple and efficient means for providing a retractable hair clipper which will provide long and efficient service.

The shaver also includes a friction reducing roller which is positioned between two arcuate perforated combs. The roller serves to lessen the friction as the shaver is moved across the face during the shaving operation. A perforated comb of this type is conventionally supported by a rigid head frame with centrally located means provided to secure the comb in a tight fashion to the supporting frame with a uniform and continuous tension. The tension bar has been modified to include spaced trunnions which permit the mounting of the roller for rotary movement.

Figure 1:
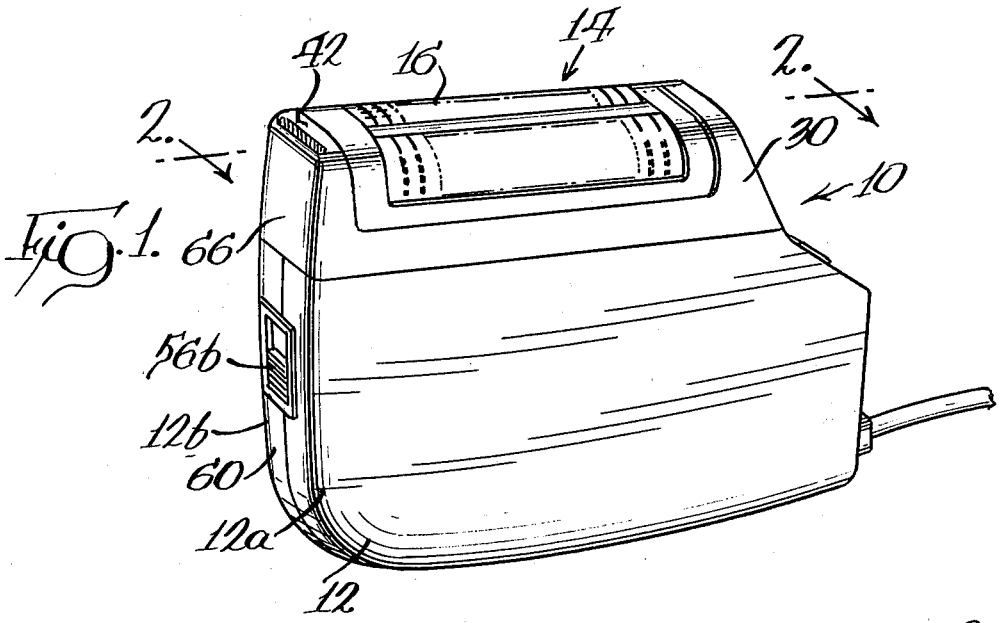
FIG. 1 is a front perspective view of a shaver embodying our invention.
Figure 7:
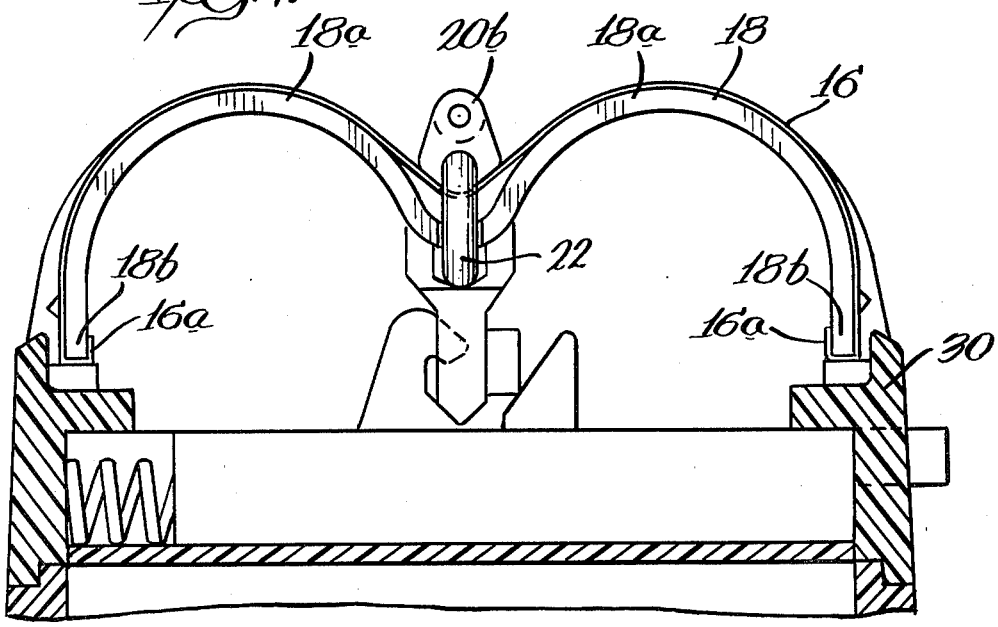
FIG. 7 is an enlarged fragmentary sectional view taken substantially on line 7—7 of FIG. 2.
Figure 8:
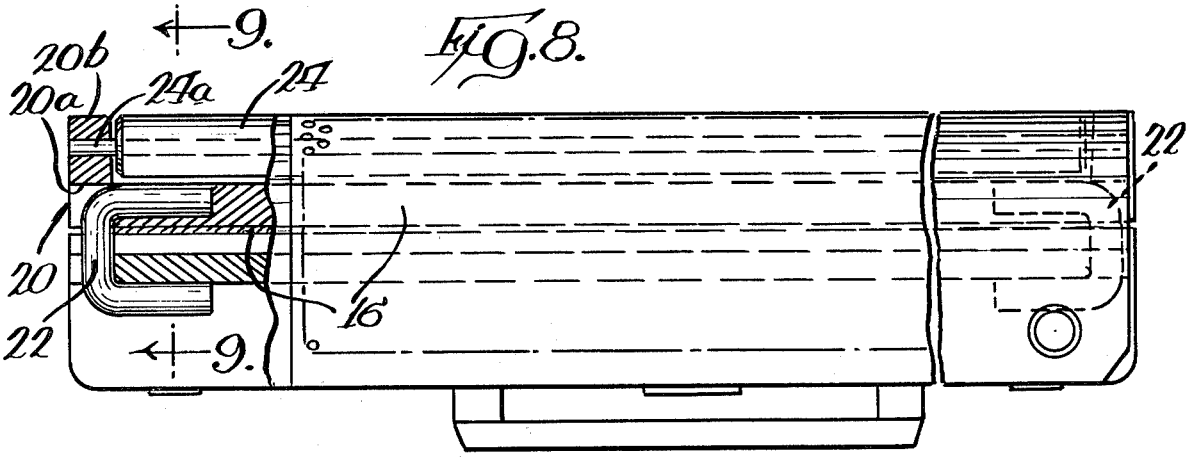
FIG. 8 is a side elevational view of the comb shown in FIG. 7 but with a portion cut away at one end to expose the tension bar support and the trunnion for supporting one end of the roller.
Figure 9:
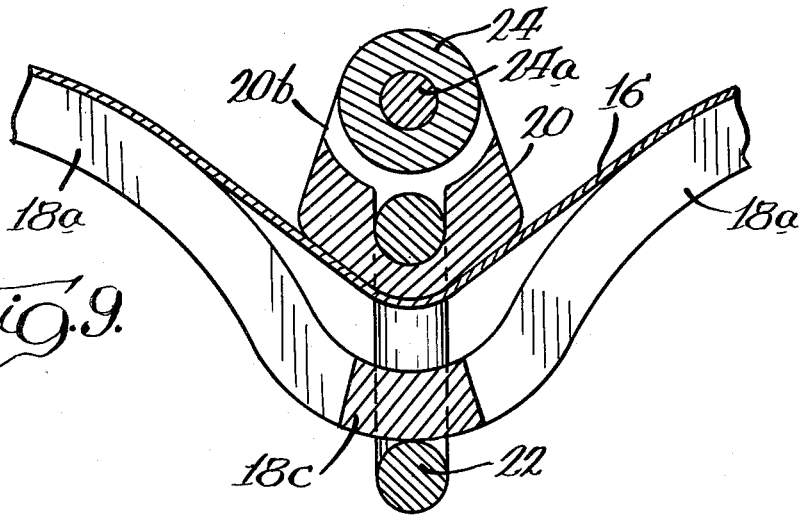
FIG. 9 is an enlarged fragmentary sectional view taken on line 9—9 of FIG. 8.

Referring now to the drawings, there is shown in FIG. 1 an electric dry shaver which is designated generally by the reference numeral 10. The dry shaver 10 includes a housing 12 which supports on one edge thereof a shaving head 14. The shaving head is conventional in construction including an outer double arched comb 16 which is supported on a frame 18. The frame has a plurality of spaced transversely extending bars 18*a* best shown in FIGS. 2 and 7, the bars serving to support the flexible comb 16 in a double arch configuration. To connect the comb 16 to the frame 18, the parallel edges of the comb 16 are folded around the adjacent edges of the frame 18 to form channel shaped edges 16*a* in which edges 18*b* of the frame are received. To retain the comb 16 snugly engaged with the frame 18, a tension bar 20 is provided extending lengthwise between the two arches formed by the comb 16 in the frame 18. The tension bar 20 is held in place by two U-shaped clips 22 which are best shown in FIGS. 7 through 9, the clips 22 engaging the frame 18 between a web portion 18*c* which interconnects the central positions of the transverse bars 18*a*. The clips 22 together with the tension bar 20 provide a resilient tensioning force which pulls on the central portion of the comb 16 which is held at its edges by the channel spaced edges 16*a* engaged by the frame edges 18*b*.

The tension bar 20 extends the entire length of the shaving head 14 having a V-shaped underside which is well radiused to bear against the comb 16 as is best shown in FIG. 9. Extending inwardly from either end of the tension bar are openings 20*a* into which the U-shaped clips 22 extend. Projecting upwardly at the ends of the tension bar 20 are apertured trunnions 20*b* which serve to support a friction reducing roller 24, the roller being substantially coextensive with the tension bar 20 and tending to reduce friction as the shaving head 14 is moved across the skin of the user during shaving. The ends of the roller 24 are provided with pins 24*a* which extend into the trunnions 20*b* to journal the roller 24 for rotary movement thereon. The pins 24*a* are pressed into the rollers 24.

The shaving head 14 includes a plurality of cutters 26 which are mounted on a pair of spaced oscillating shafts 28 mounted in a head frame 30. Suitable means are provided to oscillate the shafts 28 so that the cutters 26 move back and forth in shearing engagement with the underside of the comb 16, thereby cutting any beard stubble which extends through the perforations in the comb 16. Suitable means are provided to bias the cutters 26 against the underside of the comb 16.

Figure 2:
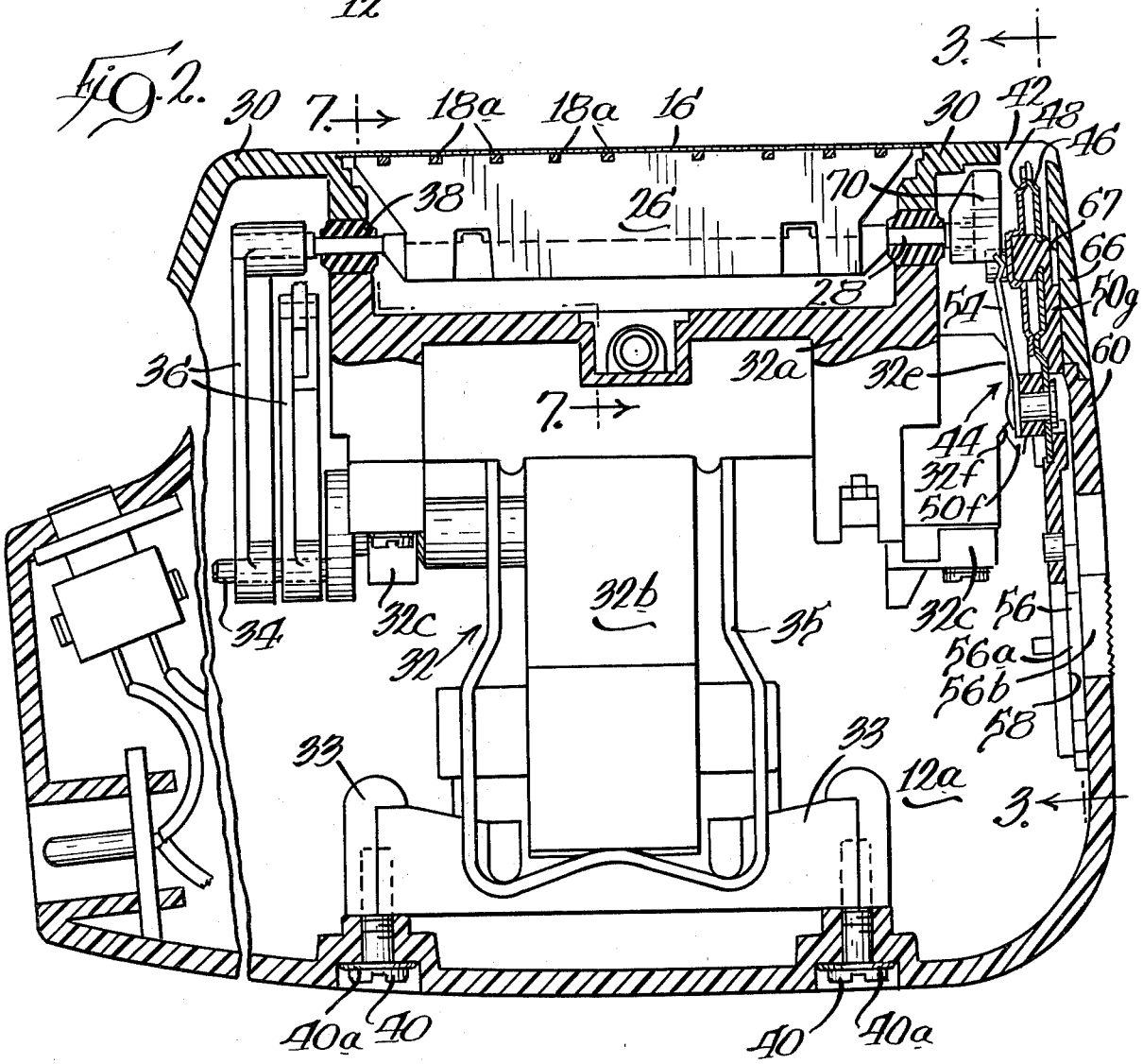
FIG. 2 is an enlarged sectional view taken substantially on line 2—2 of FIG. 1.

The housing 12 of the dry shaver 10 is formed by front housing half 12*a* and a rear housing half 12*b* which cooperate with the head frame 30 to form the enclosure within which an electric motor 32 is mounted. The abutting edges of the housing halves include tongue-in-groove cooperating portions to maintain the alignment of the housing halves and ensure a tight seal along these abutting edges. The motor 32 includes a support frame 32*a* which supports a field 32*b* and armature bearings 32*c*. The field 32*b* is sandwiched between the motor support frame 32*a* and a motor base 33 with a pair of U-shaped bail members 35 resiliently clamping the field therebetween. The output of the motor 32 is drivingly interconnected to spaced oscillating shafts 28 by means of a crank arm 34 and a pair of connecting rods 36 as best shown in FIG. 2. As a consequence, as the motor 32 operates, the crank arm 34 oscillates the connecting rods 36 causing the cutter supporting shafts 28 to oscillate.

The head frame 30 is secured to the motor chassis 32*a* by means of screws not shown. The cutter supporting shafts 28 are supported by rubber bushings 38 which are trapped in complementary recesses formed in adjacent walls of the head frame 30 and the motor chassis 32*a*. The front and rear housing halves 12*a* and 12*b* are secured together in the area adjacent the shaving head 14 by the head frame 30 which is provided with a peripheral lip 39 (see FIG. 3) which surrounds a corresponding stepped shoulder 41 formed on the upper edges of the housing halves 12*a* and 12*b*. The motor 32 and the head frame 30 are retained in the housing 12 by means of the spaced screws 40 shown best in FIG. 2. The screws 40 draw the head frame downwardly against the upwardly facing opening provided by the assembled housing halves 12*a* and 12*b*. The screws 40 bear on cup-shaped washers 40*a* which have peripheral flanges received in annular grooves in the housing halves 12*a* and 12*b* to retain the lower portions of the housing halves in tightly engaged relation.

Figure 3:
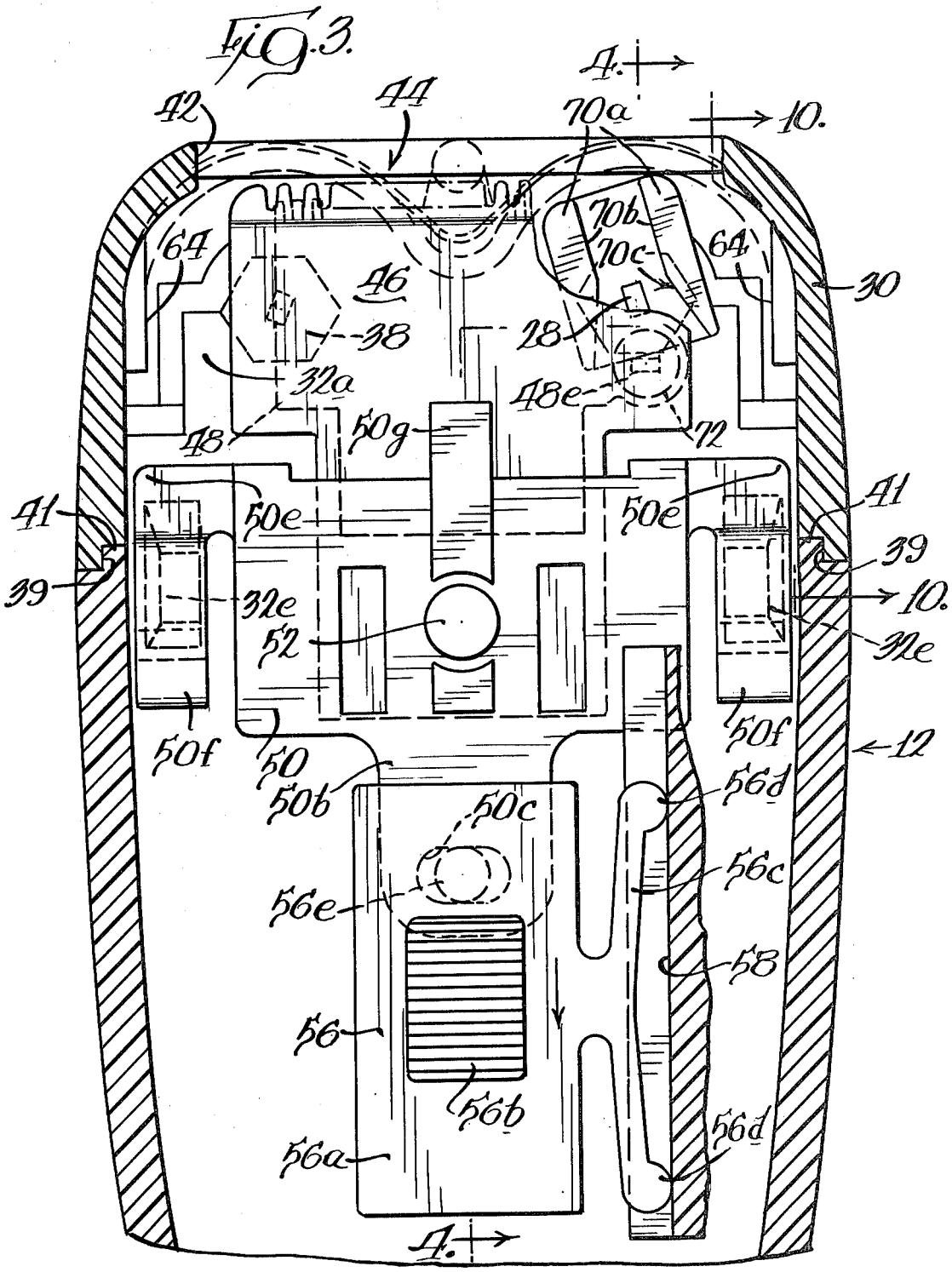
FIG. 3 is an enlarged fragmentary sectional view taken substantially along line 3—3 of FIG. 2.
Figure 4:
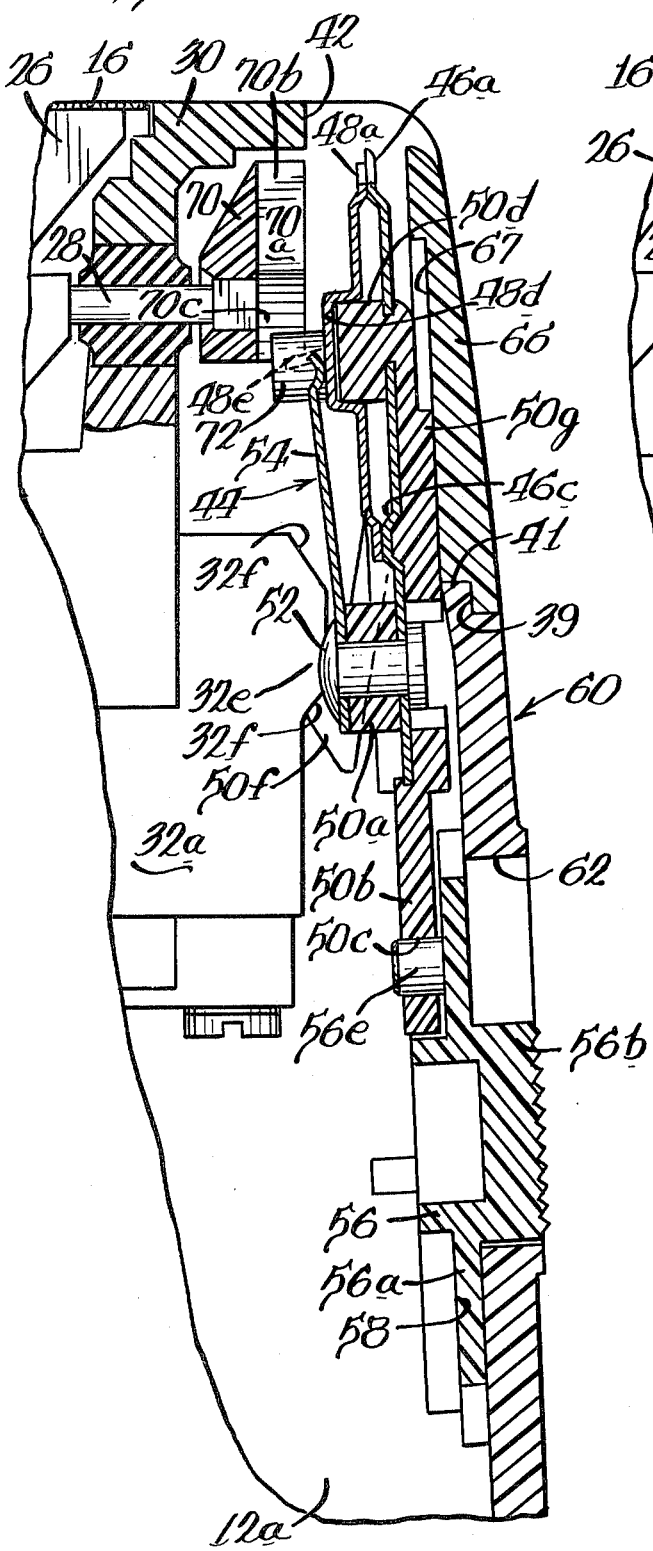
FIG. 4 is an enlarged fragmentary sectional view taken substantially on line 4—4 of FIG. 3.
Figure 5:
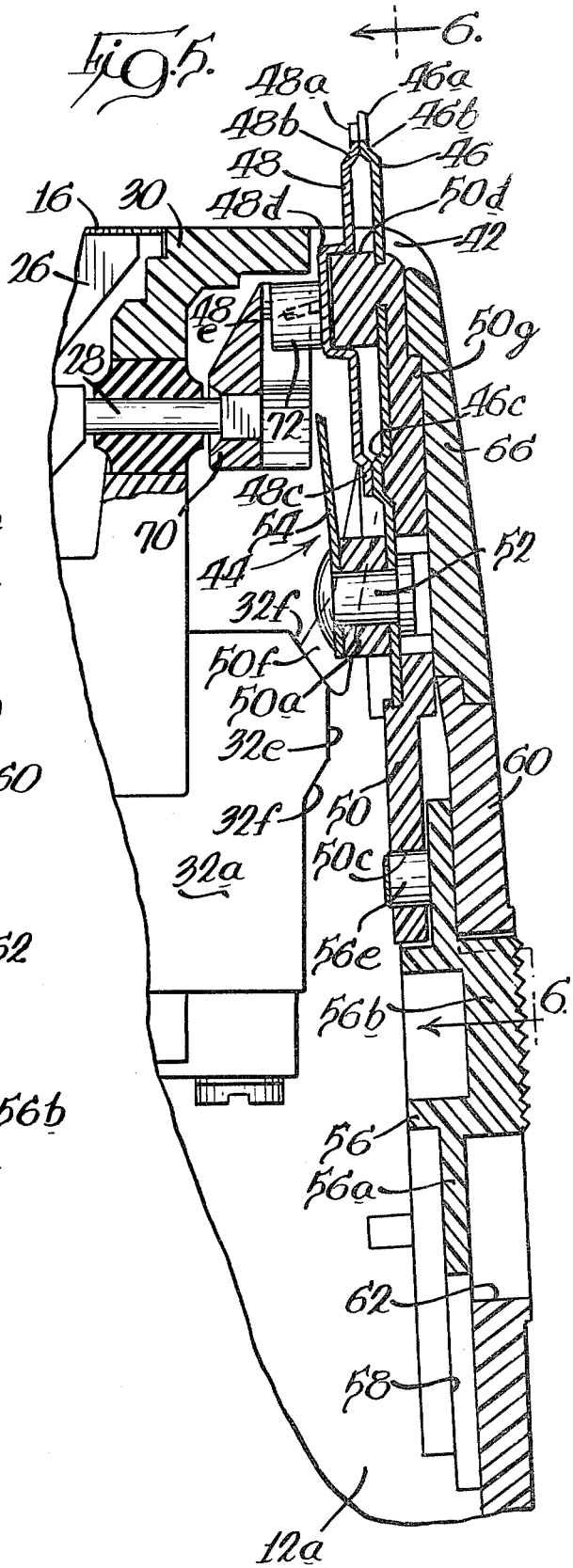
FIG. 5 is similar to FIG. 4 but shows the clipper assembly in its elevated position.
Figure 6:
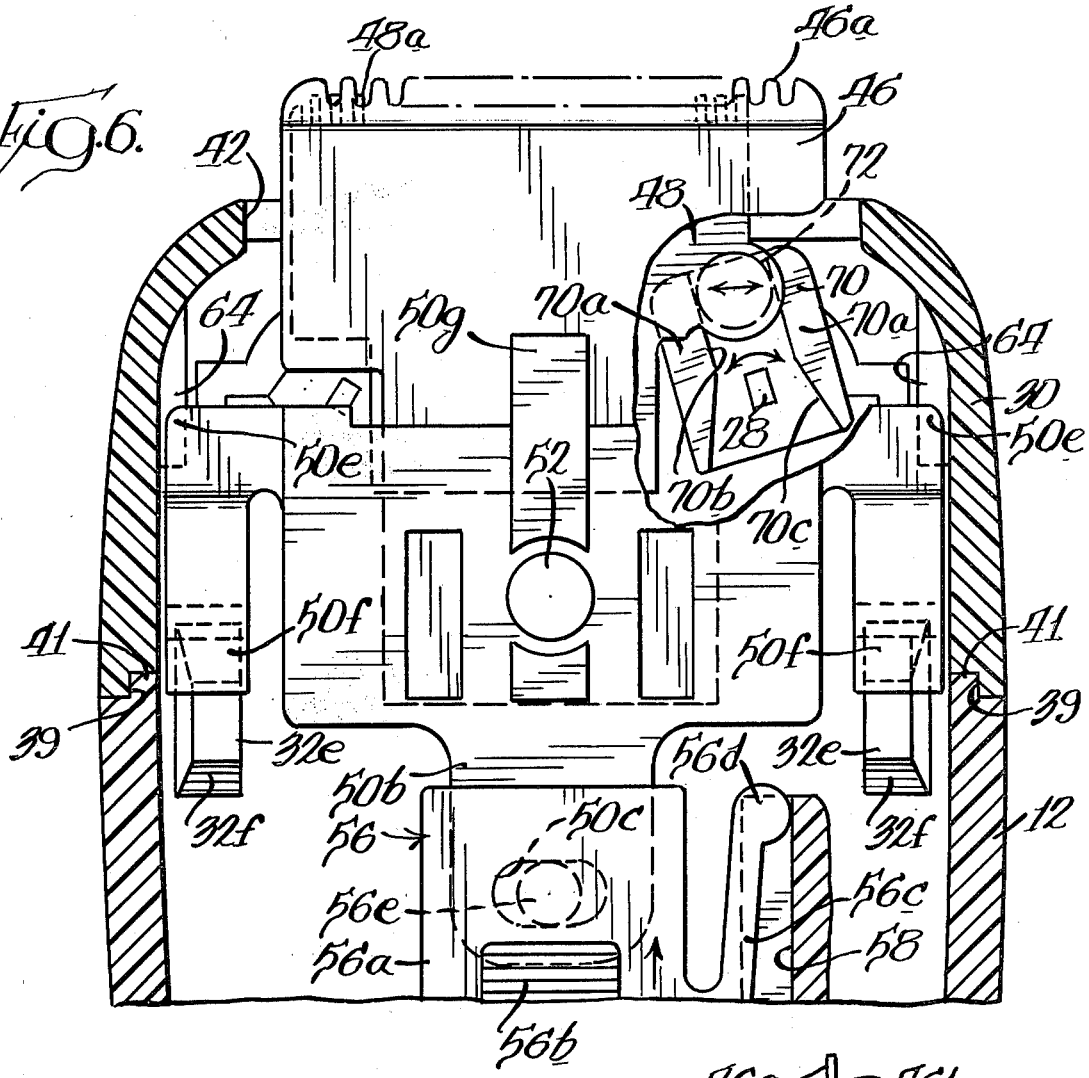
FIG. 6 is a fragmentary sectional view taken along line 6—6 of FIG. 5 with a portion cut away to show the drive linkage.

Formed in one end of the head frame 30 is a transversely extending slot 42 which is best shown in FIGS. 1 and 2. Immediately within the housing 12 below the slot 42 there is mounted the movable long hair clipper assembly 44. The clipper assembly consists of a somewhat T-shaped relatively fixed cutter or comb 46 and a relatively movable T-shaped cutter 48. The comb 46 is positioned adjacent the outer wall of the housing 12 and includes a row of teeth 46*a* along the uppermost edge as shown in FIGS. 3 and 6. The comb 46 is formed with a double bend 46*b* just back from the comb teeth 46*a* so as to displace the comb teeth from the plane of the remainder of the comb. In addition, the comb 46 intermediate its length is formed with a channel shaped bearing portion 46*c* as best shown in FIGS. 4 and 5 in order to lessen the area of engagement between the comb 46 and the cutter 48 and thereby lessen the friction.

For the purpose of supporting the comb 46 for slidable movement between its retracted and extended positions, there is provided a molded plastic support member 50 which is molded to the comb 46. A rivet 52 is utilized to secure a biasing spring 54 to the clipper assembly as shown in FIGS. 4 and 5. The support member 50 is formed with a boss 50*a* which receives the rivet 52 and is formed with a depending portion 50*b* which is provided with a slot 50*c* for driving connection with a manual actuator 56.

The manual actuator 56 is supported by opposed channel shaped recesses formed in the housing halves 12*a* and 12*b*. One of these shown in the drawings is a channel shaped recess 58 formed in the housing half 12*a* as shown in FIGS. 2, 4 and 5. The actuator 56 has a flat plate portion 56*a* which is received in the opposed channel shaped recesses in the housing halves so that the actuator is guided for limited slidable movement against the interior wall of the housing 12. The housing 12 is formed with an end wall 60 which comprises aligned walls extending from each of the housing halves 12*a* and 12*b*. Formed in the end wall 60 is an opening 62 through which a manually actuable button 56*b* formed on the actuator 56 extends. The outer surface of the button 56*b* is serrated to facilitate sliding movement of the actuator 56 by thumb pressure thereon. As may be noted from FIGS. 4 and 5, the opening 62 is substantially longer than the button 56*b* thereby permitting a substantial movement of the actuator 56 before engagement with the top or bottom of the opening 62 which determines the extent of movement permitted. Although not evident from the drawings, the width of the opening 62 is substantially equal to the width of the button 56*b* with a slight clearance being provided so that the walls of the opening surrounding the button 56 provide some support in guiding the sliding movement of the actuator 56.

Since the actuator 56 is slidably received in the grooves provided in the opposing housing halves, the part would tend to rattle or vibrate if some means were not provided to limit such vibration. As is best shown in FIGS. 3 and 6, there is provided an integrally formed laterally extending vibration damper 56*c* which is integrally molded with the actuator 56 and includes a pair of flexible appendages 56*d* which bear against the bottom of the channel spaced recess 58 to apply a biasing source urging the actuator 56 into seated engagement with the opposed channel shaped recess. In this way, it is assured that there will be no vibration noise associated with the actuator 56.

To couple the actuator 56 to the clipper assembly 44, the actuator 56 is formed with an inwardly directed projection 56*e* which is received within the slot 50*c* provided in the support member 50. Thus, as the manual actuator 56 is displaced between its lowermost position as shown in FIG. 4 and its uppermost position as shown in FIG. 5, it displaces the long hair clipper assembly 44 from its recessed position to its exposed or use position.

As was mentioned above, the clipper assembly 44 includes a cutter 48 which is provided with shearing teeth 48*a* disposed along one edge of the cutter 48 in shearing engagement with the comb teeth 46*a*. Immediately back from the cutter teeth 48*a*, the cutter 48 is formed with a double bend 48*b* which corresponds to the portion 46*b* on the comb 46 and provides limited bearing engagement between the comb 46 and the cutter 48. At the edge of the cutter most remote from the cutting teeth 48*a*, there is provided a bearing surface 48*c* which engages and cooperates with the corresponding bearing surface 46*c* formed on the comb 46. Intermediate the bearing surface 48*c* and the teeth 48*a*, the cutter 48 is formed with a channel shaped guide portion 48*d* which straddles a rib 50*d* formed on the support member 50. The rib 50*d* as well as the channel shaped guide portion 48*d* are best shown in FIGS. 4 and 5. The above disclosed biasing spring 54 has its free end in engagement with the guide portion 48*d* of the cutter 48. The boss 50*a* which supports spring 54 is provided with two spaced parallel ribs extending along the edges of the spring 54 to restrain it from rotating about rivet 52 even though it bears against the reciprocating cutter 48. The spring 54, as mounted with the rivet 52, is performed to apply a biasing force which urges the cutter 48 into engagement with the comb 46.

Figure 10:
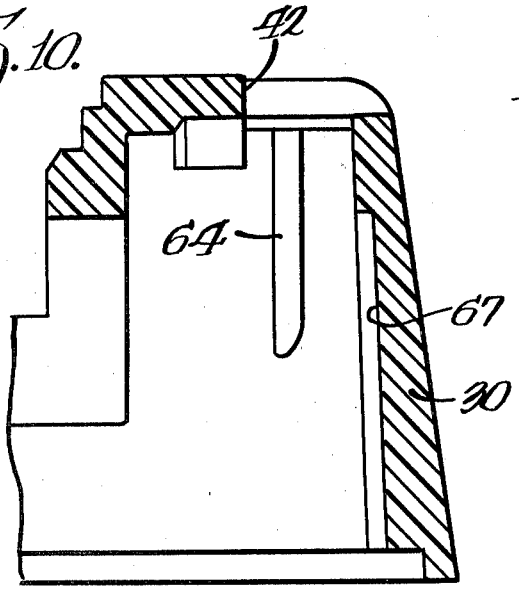
FIG. 10 is a fragmentary sectional view taken on line 10—10 of FIG. 6.

In addition to providing the connection between the actuator 56 and the clipper assembly 44, the support member 50 also guides the clipper assembly in its slidable movement between the portions shown in FIGS. 4 and 5 and provides a detent action which retains the clipper assembly 44 in either of these two alternative positions. The guiding action is accomplished by means of a pair of guide ribs 64 formed on the head frame 30 as best shown in FIGS. 3, 6 and 10 and projections 32*e* extending from the motor frame 32*a* toward the clipper assembly 44 as shown in FIGS. 4 and 5. The guide ribs 64 extend inwardly from the ends of the head frame walls defining the slot 42 and are positioned in sufficient distance from end wall 67 of the head frame 30 to capture the support member 50 therein and restrict movement of the clipper assembly 44 to sliding movement parallel to the end wall 66 and against the inside surface thereof.

The fragmentary sectional view of FIG. 10 shows the portion of the head frame including the slot 42, the guide rib 64 and the end wall 66. The support member 50 is provided with two bearing portions 50*e* which are disposed in the corners immediately above downwardly extending appendages 50*f* as are best shown in FIGS. 3 and 6. The appendages 50*f* serve as parts of a detent mechanism which retains the clipper assembly 44 in either of its alternative positions. The other part of the detent mechanism comprises the two projections 32*e* formed on the motor frame 32*a*. The frame projections 32*e*, as shown in FIGS. 3, 5 and 6 have a flat central portion which guides the clipper assembly and also includes sloping ends 32*f* which are engaged by the appendages 50*f*. The appendages 50*f* are elongated and flexible so that they may be deflected to ride over the central portion of the frame projections 32*e* as the clipper assembly 44 is moved between its two alternative positions. The manner in which the detent action is achieved may be understood by considering the relative positions of the appendages 50*f* and the frame projections 32*e* in FIGS. 4 and 5. In FIG. 4, the clipper assembly is shown in its lowermost position with the appendages 50*f* engaging the lower sloping edge 32*f* of the frame projection 32*e*, while in FIG. 5, the appendages 50*f* engages the upwardly angled edge 32*f* of the frame projection 32*e*. In both cases, the resilience of the appendages 50*f* which engage the frame projections 32*e* tends to displace the clipper assembly 44 to either the upward limit of its travel or to the lower limit of its travel and provides a means for retaining the clipper assembly in the selected position.

Considering again the bearing portion 50*e* of the support member 50, it is noted that in the extended position of the clipper assembly 44, as shown in FIGS. 5 and 6, the corners or bearing portions 50*e* of the support member 50 overlap the guiding ribs 64 thereby gripping the support member 50 between the guide rib 64 and the end wall 66 of the head frame. This provides the necessary rigidity for the upper portion of the clipper assembly 44 when it is in its extended position.

Figure 11:
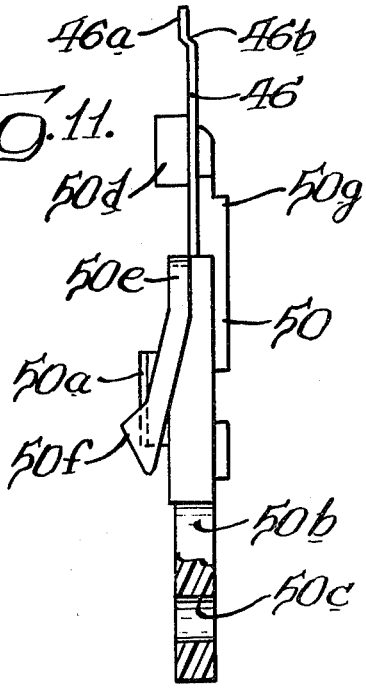
FIG. 11 is a side elevational view of the clipper comb and comb support.

When the clipper assembly 44 is in its retracted position as shown in FIGS. 3 and 4 and during part of the upward travel to the extruded position, the support member 50 has not begun to overlap the guide ribs 64 and the projections 32*e* on the motor frame cooperate with the inner surface of end wall 60 to guide the clipper assembly 44. The limits of travel of the clipper assembly 44 are determined at the retracted position by the engagement between actuator button 56*b* and the lower wall of opening 62 while in the extended position, the support member 50 engages a stop. For this purpose, the support member 50 is formed with a guide rib 50*g* as shown in FIGS. 4, 5 and 11. The rib 50*g* is received in a guiding channel 67 formed in the end wall 66 of the head frame 30. The action of the rib 50*g* in the channel 67 prevents any twisting of the clipper assembly 44 in its sliding movement and the engagement of the top end rib 50*g* with the upper end of the channel 67 provides a positive stop limiting the upward movement of the clipper assembly 44.

In order to provide the drive for the clipper assembly 44, one end of one of the cutter supporting shafts 28 is provided with a drive yoke 70 which oscillates in synchronism with the shaft 28 to which it is mounted. As best shown in FIGS. 5 and 6, the outer end of the shaft 28 is formed with a rectangular shape to improve its driving engagement with the molded plastic or die cast metal yoke 70. The yoke 70 includes a pair of spaced side walls 70*a* which define a drive slot 70*b* which has parallel spaced walls and an entrance area 70*c* which includes facing but slightly diverging side walls as best shown in FIG. 6.

The driving connection between the yoke 70 and the cutter 48 is accomplished by means of a drive lug 72 which is supported on an integrally formed tab 48*e* formed out of the cutter 48 and extending generally perpendicular to the plane of the cutter 48 as best shown in FIG. 5. The drive lug 72 is of generally cylindrical configuration having a diameter which is slightly less than the spaced walls in the driving portion 70*b* of the lug 70. To appreciate the manner in which the selective drive between the shaft 28 and the clipper assembly 44 is accomplished, reference should be had to FIGS. 4, 5 and 6. In FIG. 4, the drive lug and the clipper assembly are shown in their idle or no driving position in which the lug 72 barely overlaps the bottom edge of the fork 70. In this position, the diverging wall 70*c* on the fork 70 is sufficiently spaced so that even as the shaft 28 oscillates, causing the fork 70 to oscillate, there is no reciprocation of the cutter 48 by the drive lug 72 and the fork 70.

When the actuator 56 is employed to move the clipper assembly 44 to the operating or exposed position, as shown in FIGS. 5 and 6, the drive lug 72 moves into the drive slot 70*b* of the fork 70. Since, in that position, the yoke 70 straddles the drive lock 72 snugly, the oscillation of the shaft 28 and yoke 70 will cause the cutter 48 to reciprocate back and forth in shearing engagement with the comb 46. The diverging walls 70*c* of the yoke 70 permit the drive lug 72 to move up into its driving relation with the yoke regardless of the manner in which the cutter 48 might have been displaced or moved relative to the initial position of the yoke 70 prior to the clipper assembly 44 being moved into the exposed position.

The above described clipper provides the ultimate in structural simplicity while retaining all of the necessary functional advantages of more expensive and more complicated long hair clippers. The multiple functions performed by the support member 50 permit the clipper assembly to assume a very simple form having only the two shear plates and the biasing spring in addition to the molded plastic support. The adjacent portions of the housing provide the guiding and detent action and the use of the drive fork on the cutter shaft provides a simple and inexpensive means for driving a long hair clipper.

The use of the tension bar 20 having the integrally formed trunnions 20*b* also provides a greatly simplified means for mounting a friction reducing roller in connection with a shaving head, the only additional cost being the roller itself with its supporting pins. The result is an improved shaving action at very little additional cost.

While only a single embodiment of the present invention has been shown, it will be understood that various changes and modifications will occur to those skilled in the art and it is contemplated in the appended claims to cover all such changes and modifications as fall within the true spirit and scope of the present invention.

What is claimed as new and desired to be secured by Letters Patent of the United States is:

1. An electric shaver including an improved long hair clipper comprising a housing enclosing a motor drivingly connected to a shaving head mounted on a wall of said housing, said head having an arched comb and oscillating cutting means in shearing engagement with said comb, an oscillating shaft mounted for oscillation about its axis and disposed beneath said comb for supporting said cutting means for oscillation about said shaft axis, said shaft being connected to be oscillated by said motor, a long hair clipper assembly mounted adjacent one end of said oscillating shaft for linear slidable movement between a retracted position within said housing to an exposed position in which a portion of said assembly projects outside of said housing, said clipper assembly including a comb having teeth formed along one edge thereof, a support member secured to said comb and having guiding portions which engage portions of said housing to control the linear sliding movement of said clipper assembly, a cutter supported on said comb with teeth on one edge thereof, means biasing said cutter into engagement with said comb whereby said comb and said cutter teeth are in shearing engagement, detent means for retaining said assembly in either said retracted or said exposed position, said comb and said cutter being flat planar members having transverse bearing portions formed thereon for supporting said comb and cutter for relative sliding engagement, said support member being molded onto said comb to enclose a portion thereof, said support member including a transverse rib received within a transverse channel formed on said cutter to guide said cutter for linear movement with respect to said comb, and said means biasing said cutter being mounted on said support member, means on said cutter and said oscillating shaft which drivingly interconnects said shaft with said cutter to reciprocate said cutter when said clipper assembly is in said exposed position.

2. The electric shaver of claim 1 wherein said support member includes a pair of resilient projecting portions and cooperating projections on said motor which engage projecting portions to provide said detent means.

3. In an electric shaver having a housing enclosing an electric motor which is drivingly connected to a shaving head mounted exteriorly of said housing, said shaving head including an arched comb and oscillating cutting means in shearing engagement with said comb, an oscillating shaft mounted for oscillation about its axis and disposed beneath said comb for supporting said cutting means for oscillation about said shaft axis, said motor being drivingly connected to oscillate said shaft, an improved long hair clipper comprising a yoke mounted on one end of said shaft and driven for oscillatory movement about a fixed axis corresponding to the axis of said shaft, said yoke including a drive portion having spaced parallel walls positioned so that a plane equidistant between them extends through said fixed axis, diverging wall portions on said yoke extending from said drive portion walls and straddling said fixed axis, a long hair clipper assembly slidably supported within said housing for movement between a retracted position entirely within said housing and an exposed position in which a portion thereof extends outwardly through an opening in said housing, said clipper assembly including a comb and a cutter having cooperating teeth in shearing engagement, a drive lug carried by said cutter and positioned to be received between said parallel walls and driven by the drive portion of said yoke when said clipper assembly is in the exposed position, in said retracted position said drive lug being positioned between said diverging walls of said yoke whereby no driving action takes place between said yoke and said cutter.

4. The combination of claim 3 wherein said clipper assembly is supported for linear sliding movement in said housing by a plastic support member molded integrally on said comb, guide means within said housing in engagement with said support member to restrict said clipper assembly to linear sliding movement.

5. The combination of claim 4 wherein said support member engages guide ribs and channels formed in the walls of said housing, detent means on said support member and said motor to retain said clipper assembly in either of said positions.

6. The combination of claim 5 wherein said detent means comprises a pair of flexible integrally formed appendages on said support member engaging projections which extend from said motor.

7. The combination of claim 6 wherein said clipper assembly includes a leaf having one end secured to said support member and the other end engaging said cutter to bias it into engagement with said comb, said support member being formed with a transverse rib which is received in a channel formed in said cutter to guide said cutter for reciprocating movement with respect to said comb.

* * * * *